US009352343B2

(12) United States Patent
Bierie

(10) Patent No.: US 9,352,343 B2
(45) Date of Patent: May 31, 2016

(54) LIQUID SUPPLY SYSTEM FOR A GRAVITY FEED SPRAY DEVICE

(71) Applicant: Finishing Brands Holdings Inc., Minneapolis, MN (US)

(72) Inventor: William K. Bierie, Swanton, OH (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 7 days.

(21) Appl. No.: 14/146,617

(22) Filed: Jan. 2, 2014

(65) Prior Publication Data

US 2014/0203098 A1 Jul. 24, 2014

Related U.S. Application Data

(60) Provisional application No. 61/755,410, filed on Jan. 22, 2013.

(51) Int. Cl.

| | |
|---|---|
| ***B05B 7/30*** | (2006.01) |
| ***B05B 7/24*** | (2006.01) |
| *B05B 7/08* | (2006.01) |

(52) U.S. Cl.

CPC ..... *B05B 7/247* (2013.01); *B05B 7/2408* (2013.01); *B05B 7/2478* (2013.01); *B05B 7/0815* (2013.01)

(58) Field of Classification Search

CPC .... B05B 7/247; B05B 7/2478; B05B 7/0815; B05B 7/2408

USPC ..... 239/345, 376, 377, 379; 141/351; 220/495.02

See application file for complete search history.

(56) References Cited

U.S. PATENT DOCUMENTS

| | | | |
|---|---|---|---|
| 1,824,017 | A | 9/1931 | Hersleb et al. |
| 1,837,844 | A | 12/1931 | Wyzenbeek |
| 1,944,920 | A | 1/1934 | Bramsen |
| 2,263,842 | A | 11/1941 | Gross |
| 2,934,246 | A | 4/1960 | Briggs |
| 3,136,486 | A | 6/1964 | Docken |
| 3,157,360 | A | 11/1964 | Heard |
| 3,240,398 | A | 3/1966 | Dalton, Jr. |

(Continued)

FOREIGN PATENT DOCUMENTS

| | | | |
|---|---|---|---|
| EP | 2450108 | A2 | 5/2012 |
| WO | 03095101 | A1 | 11/2003 |

(Continued)

OTHER PUBLICATIONS

International Search Report and Written Opinion for PCT Application No. PCT/US2014/010730 dated May 22, 2014; 9 pgs.

(Continued)

*Primary Examiner* — Jason Boeckmann
(74) *Attorney, Agent, or Firm* — Fletcher Yoder, P.C.

(57) ABSTRACT

A system, including a gravity fed container assembly, including a container, a lid configured to cover a chamber in the spray coating supply container, wherein the chamber is configured to hold a spray material, a filter assembly within the chamber and configured to filter the spray material in the chamber, and a valve coupled to the filter assembly and configured to open when the container couples to a spray device, wherein the valve is configured to move the filter assembly from a first position to a second position, wherein the first position blocks the filter assembly from filtering the spray material and the second position enables filtering of the spray material.

8 Claims, 6 Drawing Sheets

(56) References Cited

U.S. PATENT DOCUMENTS

| | | | | |
|---|---|---|---|---|
| 3,432,194 | A | 3/1969 | Garnier | |
| 3,714,967 | A | 2/1973 | Zupan et al. | |
| 3,893,627 | A | 7/1975 | Siczek et al. | |
| 3,990,609 | A | 11/1976 | Grant | |
| 4,174,070 | A | 11/1979 | Lau et al. | |
| 4,174,071 | A | 11/1979 | Lau et al. | |
| 4,184,778 | A | 1/1980 | Terrels | |
| 4,433,812 | A | 2/1984 | Grime | |
| 4,501,500 | A | 2/1985 | Terrels | |
| 4,606,501 | A | 8/1986 | Bate et al. | |
| 4,730,753 | A | 3/1988 | Grime | |
| 4,760,962 | A | 8/1988 | Wheeler | |
| 4,811,904 | A * | 3/1989 | Ihmels et al. | 239/345 |
| 4,832,232 | A | 5/1989 | Broccoli | |
| 4,948,042 | A | 8/1990 | Tench et al. | |
| 5,052,623 | A | 10/1991 | Nordeen | |
| 5,054,687 | A | 10/1991 | Burns et al. | |
| 5,067,518 | A | 11/1991 | Kosmyna | |
| 5,119,992 | A | 6/1992 | Grime | |
| 5,209,365 | A | 5/1993 | Wood | |
| 5,307,994 | A | 5/1994 | Hieronymus | |
| 5,582,350 | A | 12/1996 | Kosmyna et al. | |
| 5,667,142 | A | 9/1997 | Newman | |
| 5,803,360 | A | 9/1998 | Spitznagel | |
| 5,810,258 | A | 9/1998 | Wu | |
| 5,853,102 | A | 12/1998 | Jarrett | |
| 5,918,815 | A | 7/1999 | Wu | |
| 6,012,651 | A | 1/2000 | Spitznagel | |
| 6,053,429 | A | 4/2000 | Chang | |
| 6,189,809 | B1 | 2/2001 | Schwebemeyer | |
| 6,213,410 | B1 | 4/2001 | Spitznagel | |
| 6,435,410 | B2 | 8/2002 | Edens et al. | |
| 6,536,687 | B1 | 3/2003 | Navis et al. | |
| 6,588,681 | B2 | 7/2003 | Rothrum et al. | |
| 6,595,441 | B2 | 7/2003 | Petrie et al. | |
| 6,663,018 | B2 | 12/2003 | Rothrum et al. | |
| 6,752,179 | B1 | 6/2004 | Schwartz | |
| 6,796,514 | B1 | 9/2004 | Schwartz | |
| 6,820,824 | B1 | 11/2004 | Joseph et al. | |
| 6,938,836 | B2 * | 9/2005 | Bouic | 239/346 |
| 6,942,126 | B2 | 9/2005 | Douglas et al. | |
| 6,953,155 | B2 | 10/2005 | Joseph et al. | |
| 7,083,119 | B2 | 8/2006 | Bouic et al. | |
| 7,086,549 | B2 | 8/2006 | Kosmyna et al. | |
| 7,090,148 | B2 | 8/2006 | Petrie et al. | |
| 7,165,732 | B2 | 1/2007 | Kosmyna et al. | |
| 7,172,139 | B2 | 2/2007 | Bouic et al. | |
| 7,175,110 | B2 | 2/2007 | Vicentini | |
| 7,188,785 | B2 | 3/2007 | Joseph et al. | |
| 7,263,893 | B2 | 9/2007 | Kosmyna et al. | |
| 7,344,040 | B2 | 3/2008 | Kosmyna et al. | |
| 7,350,418 | B2 | 4/2008 | Kosmyna et al. | |
| 7,353,964 | B2 | 4/2008 | Kosmyna | |
| 7,354,074 | B2 | 4/2008 | Kosmyna et al. | |
| 7,373,111 | B2 | 5/2008 | Gupta | |
| 7,380,680 | B2 | 6/2008 | Kosmyna et al. | |
| 7,416,140 | B2 | 8/2008 | Camilleri et al. | |
| 7,565,983 | B2 | 7/2009 | Kosmyna et al. | |
| 7,568,638 | B2 | 8/2009 | Gehrung | |
| 7,614,517 | B2 | 11/2009 | Zheng | |
| 7,625,016 | B2 | 12/2009 | Kosmyna et al. | |
| 7,665,672 | B2 * | 2/2010 | Kosmyna et al. | 239/1 |
| 7,712,682 | B2 | 5/2010 | Joseph et al. | |
| 7,744,011 | B2 | 6/2010 | Kosmyna et al. | |
| 7,753,289 | B2 | 7/2010 | Kosmyna et al. | |
| 7,757,972 | B2 | 7/2010 | Kosmyna et al. | |
| 7,776,250 | B2 | 8/2010 | Low et al. | |
| 7,789,324 | B2 | 9/2010 | Bouic et al. | |
| 7,798,421 | B2 | 9/2010 | Joseph et al. | |
| 7,798,425 | B2 | 9/2010 | Joseph et al. | |
| 7,798,426 | B2 | 9/2010 | Joseph et al. | |
| 7,798,427 | B2 | 9/2010 | Joseph et al. | |
| 7,815,130 | B2 | 10/2010 | Joseph et al. | |
| 7,815,132 | B2 | 10/2010 | Baltz | |
| 7,823,806 | B2 | 11/2010 | Schmon | |
| 7,845,582 | B2 | 12/2010 | Joseph et al. | |
| 7,874,323 | B2 | 1/2011 | Kosmyna | |
| 7,891,588 | B2 | 2/2011 | Jones et al. | |
| 8,002,200 | B2 | 8/2011 | Joseph et al. | |
| 8,052,071 | B2 | 11/2011 | Kruse | |
| 2004/0251269 | A1 | 12/2004 | Gosis et al. | |
| 2006/0049099 | A1 | 3/2006 | Chang | |
| 2006/0102550 | A1 | 5/2006 | Joseph et al. | |
| 2010/0108783 | A1 | 5/2010 | Joseph et al. | |

FOREIGN PATENT DOCUMENTS

| | | | |
|---|---|---|---|
| WO | 2004037431 | A1 | 5/2004 |
| WO | 2007149760 | A2 | 12/2007 |
| WO | 2008085533 | A2 | 7/2008 |
| WO | 2012154619 | A2 | 11/2012 |
| WO | 2012154625 | A2 | 11/2012 |

OTHER PUBLICATIONS

Australian Examination Report for AU Application No. 2014209781 issued Jan. 5, 2016, 3 pages.

Taiwanese Office Action for TW Application No. 103102307 issued on Mar. 14, 2016, 8 pages.

* cited by examiner

LIQUID SUPPLY SYSTEM FOR A GRAVITY FEED SPRAY DEVICE

BACKGROUND

The invention relates generally to spray devices, and, more particularly, to liquid supply containers for spray devices.

Spray coating devices are used to apply a spray coating to a wide variety of target objects. Spray coating devices often include many reusable components, such as a container to hold a liquid coating material (e.g., paint) on a gravity feed spray device. Unfortunately, a considerable amount of time is spent cleaning these reusable components. Furthermore, the liquid coating material is often mixed and then transferred from a mixing cup to the container coupled to the gravity feed spray device. Accordingly, a considerable amount of time is spent to prepare and transfer liquid coating material to the container and to then clean the container after use.

BRIEF DESCRIPTION

In a first embodiment, a system, including a gravity fed container assembly, including a container, a lid configured to cover a chamber in the spray coating supply container, wherein the chamber is configured to hold a spray material, a filter assembly within the chamber and configured to filter the spray material in the chamber, and a valve coupled to the filter assembly and configured to open when the container couples to a spray device, wherein the valve is configured to move the filter assembly from a first position to a second position, wherein the first position blocks the filter assembly from filtering the spray material and the second position enables filtering of the spray material.

In a second embodiment, a system, including, a gravity fed container assembly including, a container comprising an intake, a chamber, and an outlet, and a valve configured to open and close the outlet, the valve including, an annular portion configured to form a seal with the container, and a base portion comprising ribs or panels configured to allow a fluid to pass through the valve in an open position.

In a third embodiment, a method, including filtering a spray material in a container via a filter assembly, and biasing a valve in the container from an open position toward a closed position relative to an outlet, wherein the valve is configured to move from the closed position to the open position upon attachment of the container to a spray device.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is generally directed to a spray coating gun assembly with a gravity fed container assembly. More specifically, the disclosure is directed to a disposable/recyclable container with an integrated valve and filter assembly, which has the valve normally closed or biased toward a closed position to contain a stored liquid coating material. The integrated valve and filter assembly enables a user to add, measure, and mix a liquid coating material in a single container before attachment to a spray coating gun. The ability to add, measure, and mix a liquid coating material in a single container reduces preparation time and waste of liquid coating material. Upon connecting the container assembly to a spray coating gun, the valve may automatically move to an open position and/or a manual actuator may be used to open the valve. Furthermore, the gravity fed container assembly may bias the valve toward a closed position enabling a user to separate the container after spraying, thus saving unsprayed liquid coating material for later use. In some embodiments, the filter assembly itself may function as a spring (e.g., providing a spring biasing force) to bias the valve toward a closed position. In other embodiments, a spring may bias the valve toward a closed position. In still other embodiments, the valve may automatically open and remain open upon connecting the gravity fed container to the spray coating gun.

Figure 1:
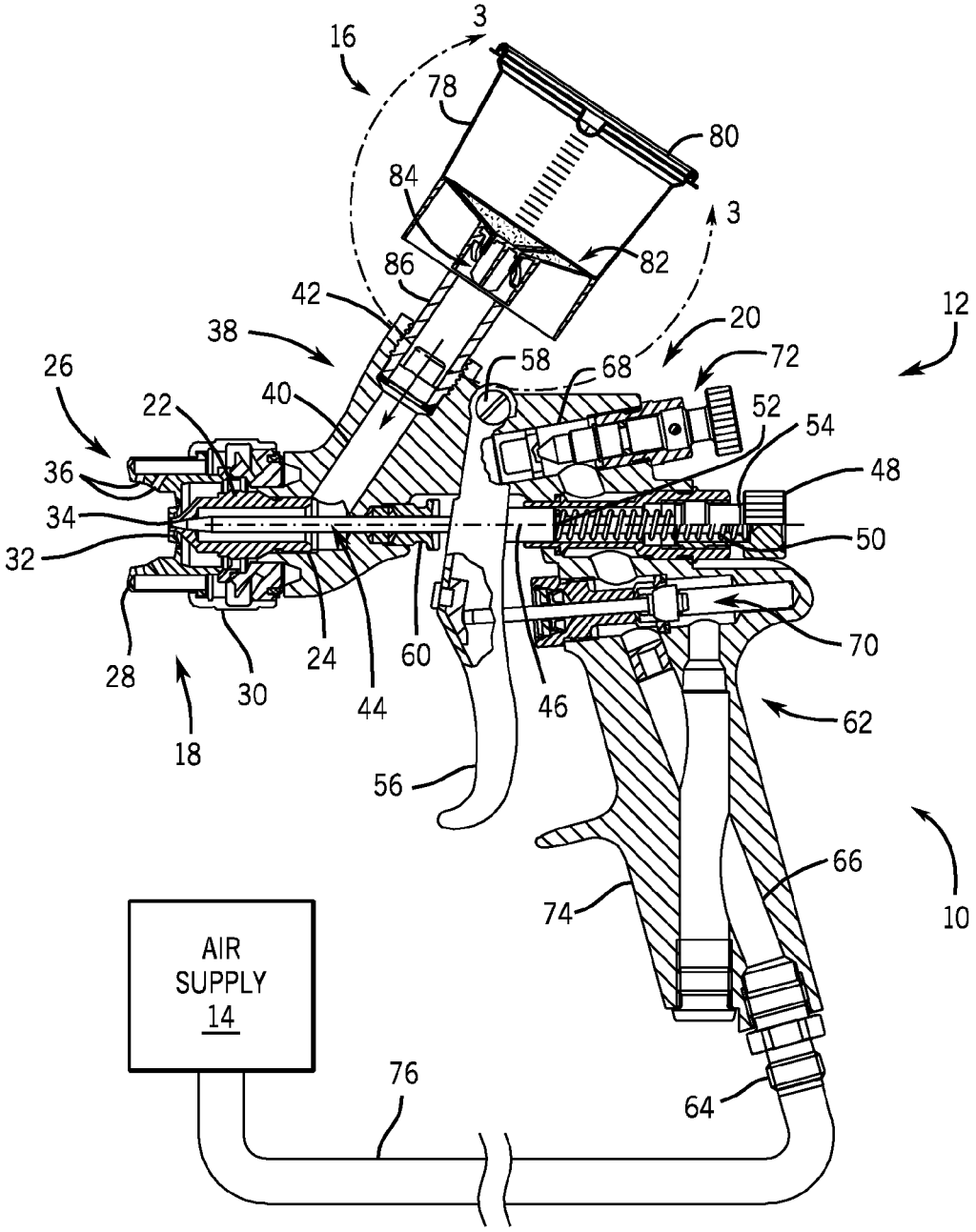
FIG. 1 is a cross-sectional side view of an embodiment of a gravity fed container assembly coupled to a spray coating device FIG. 1.

FIG. 1 is a cross-sectional side view illustrating an embodiment of the spray coating gun assembly 10. The spray coating gun assembly includes a spray coating gun 12, an air supply 14, and a gravity fed container assembly 16. As illustrated, the spray coating gun 12 includes a spray tip assembly 18 coupled to a body 20. The spray tip assembly 18 includes a liquid delivery tip assembly 22, which may be removably inserted into a receptacle 24 of the body 20. For example, a plurality of different types of spray coating devices may be configured to receive and use the liquid delivery tip assembly 22. The spray tip assembly 18 also includes a spray formation assembly 26 coupled to the liquid delivery tip assembly 22. The spray formation assembly 26 may include a variety of spray formation mechanisms, such as air, rotary, and electrostatic atomization mechanisms. However, the illustrated spray formation assembly 26 comprises an air atomization cap 28, which is removably secured to the body 20 via a retaining nut 30. The air atomization cap 28 includes a variety of air atomization orifices, such as a central atomization orifice 32 disposed about a liquid tip exit 34 from the liquid delivery tip assembly 22. The air atomization cap 28 may also have one or more spray shaping air orifices, such as spray shaping orifices 36, which use air jets to force the spray to form a desired spray pattern (e.g., a flat spray). The spray formation assembly 26 may also include a variety of other atomization mechanisms to provide a desired spray pattern and droplet distribution.

The body 20 of the spray coating gun 12 includes a variety of controls and supply mechanisms for the spray tip assembly 18. As illustrated, the body 20 includes a liquid delivery assembly 38 having a liquid passage 40 extending from a liquid inlet coupling 42 to the liquid delivery tip assembly 22. The liquid delivery assembly 38 also includes a liquid valve assembly 44 to control liquid flow through the liquid passage 40 and to the liquid delivery tip assembly 22. The illustrated liquid valve assembly 44 has a needle valve 46 extending movably through the body 20 between the liquid delivery tip assembly 22 and a liquid valve adjuster 48. The liquid valve adjuster 48 is rotatably adjustable against a spring 50 disposed between a rear section 52 of the needle valve 46 and an internal portion 54 of the liquid valve adjuster 48. The needle valve 46 is also coupled to a trigger 56, such that the needle valve 46 may be moved inwardly away from the liquid delivery tip assembly 22 as the trigger 56 is rotated counter clockwise about a pivot joint 58. However, any suitable inwardly or outwardly openable valve assembly may be used within the scope of the present technique. The liquid valve assembly 44 also may include a variety of packing and seal assemblies, such as packing assembly 60, disposed between the needle valve 46 and the body 20.

An air supply assembly 62 is also disposed in the body 20 to facilitate atomization at the spray formation assembly 26. The illustrated air supply assembly 62 extends from an air inlet coupling 64 to the air atomization cap 28 via air passages 66 and 68. The air supply assembly 62 also includes a variety of seal assemblies, air valve assemblies, and air valve adjusters to maintain and regulate the air pressure and flow through the spray coating gun 12. For example, the illustrated air supply assembly 62 includes an air valve assembly 70 coupled to the trigger 56, such that rotation of the trigger 56 about the pivot joint 58 opens the air valve assembly 70 to allow air flow from the air passage 66 to the air passage 68. The air supply assembly 62 also includes an air valve adjustor 72 to regulate the air flow to the air atomization cap 28. As illustrated, the trigger 56 is coupled to both the liquid valve assembly 44 and the air valve assembly 70, such that liquid and air simultaneously flow to the spray tip assembly 18 as the trigger 56 is pulled toward a handle 74 of the body 20. Once engaged, the spray coating gun 12 produces an atomized spray with a desired spray pattern and droplet distribution.

In the illustrated embodiment of FIG. 1, the gravity fed container assembly 16 and the air supply 14 provide a respective liquid coating material and air to the spray coating gun 12. The air supply 14 enables the spray coating gun 12 to spray and shape the liquid coating material exiting the gravity fed container assembly 16. The air supply 14 couples to the spray gun 12 at air inlet coupling 64 and supplies air via air conduit 76. Embodiments of the air supply 14 may include an air compressor, a compressed air tank, a compressed inert gas tank, or a combination thereof. In the illustrated embodiment, the gravity fed container assembly 16 is directly mounted to the spray coating gun 12 to supply a liquid coating material (e.g., a solvent, paint, sealer, stain, etc.) to the spray coating gun 12. The illustrated gravity fed container assembly 16 includes a spray coating supply container 78, a lid 80, a filter assembly 82, a valve 84, and an adapter 86.

In certain embodiments, all or some of the components in the gravity fed container assembly 16 may be designed for a single use application (i.e., the spray coating supply container 78, the lid 80, the filter assembly 82, and the valve 84). The components in the gravity fed container assembly 16 may be made of a disposable and/or recyclable material, such as a transparent or translucent plastic, a fibrous or cellulosic material, a non-metallic material, or some combination thereof. For example, the gravity fed container assembly 16 may be made entirely (e.g., 100 percent) or substantially (e.g., greater than 75, 80, 85, 90, 95, 99 percent) from a disposable and/or recyclable material. Embodiments of a gravity fed container assembly 16 include a material composition consisting essentially or entirely of a polymer, e.g., polyethylene. Embodiments of a fibrous container assembly 140 include a material composition consisting essentially or entirely of natural fibers (e.g., vegetable fibers, wood fibers, animal fibers, or mineral fibers) or synthetic/man-made fibers (e.g., cellulose, mineral, or polymer). Examples of cellulose fibers include modal or bamboo. Examples of polymer fibers include nylon, polyester, polyvinyl chloride, polyolefins, aramids, polyethylene, elastomers, and polyurethane.

Figure 2:
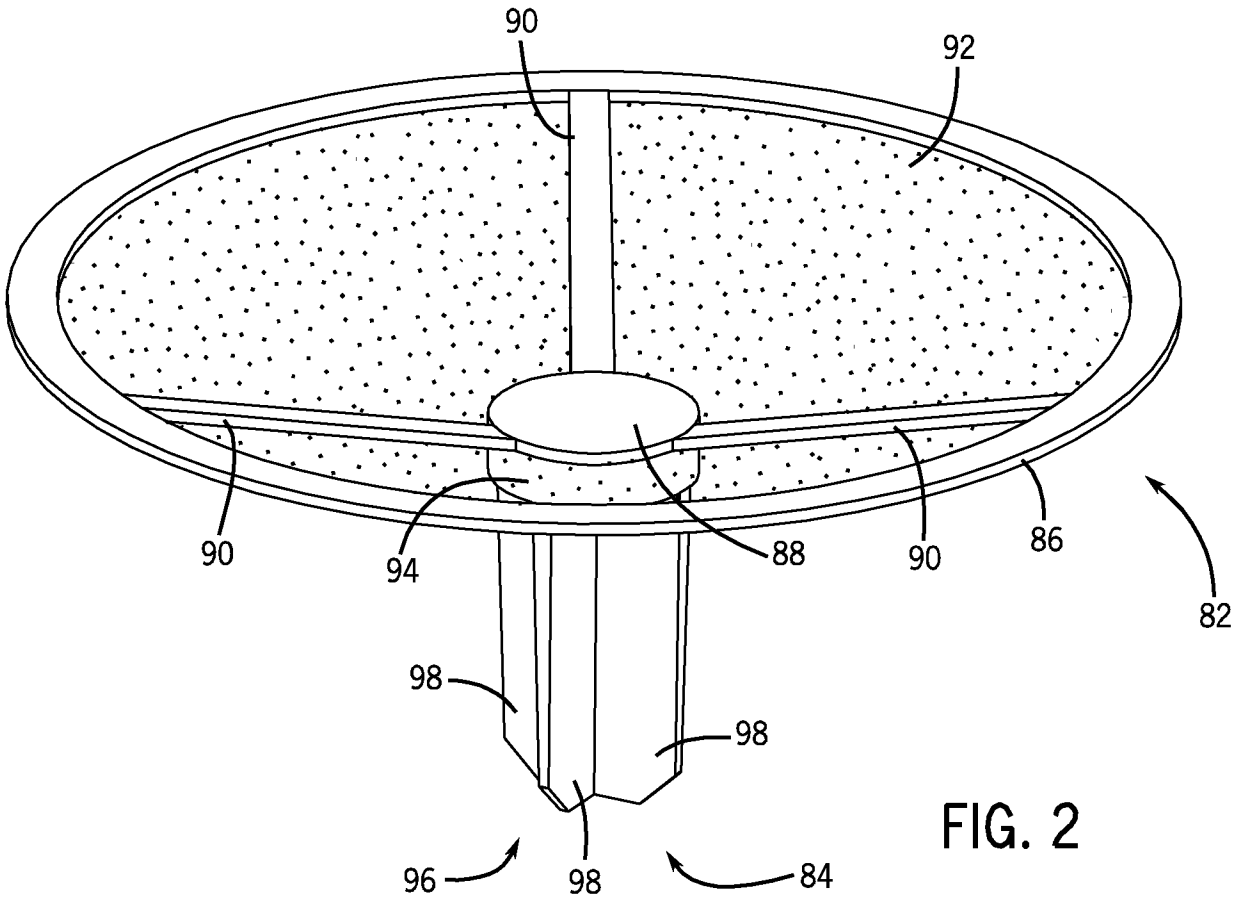
FIG. 2 is a perspective view of an embodiment of a filter assembly and a valve.

FIG. 2 is a perspective view of an embodiment of the filter assembly 82 coupled to the valve 84. In certain embodiments, the filter assembly 82 and the valve 84 may be a single component, e.g., integrated together as one-piece. In other embodiments, the filter assembly 82 and the valve 84 may be separate components coupled together for use in the gravity fed container assembly 16. The filter assembly 82 includes an outer ring 86, an inner disc 88, support arms 90, and a filter or mesh 92. The mesh 92 may have a mesh spacing or opening size of equal, lesser than, or greater than approximately 50, 75, 100, 125, 150, 175, 200, 225, or 250 microns for filtering a liquid coating material exiting the gravity fed container assembly 16. In certain embodiments, the filter or mesh 92 may include a sheet of filter material or screen material, such as a paper filter, a metal or plastic screen, or a membrane sheet. The mesh 92 and support arms 90 extend from the outer ring 86 to the inner disc 88. The support arms 90 may support the mesh (e.g., one sheet of conical mesh) and/or provide a connection point for different segments of mesh 92 (i.e., mesh segments may stretch between and couple to neighboring support arms 90). The arms 90 may be made out of a recyclable material, such as plastic. In the present embodiment, there are three support arms 90, but in other embodiments there may be different numbers of support arms (e.g., 1, 2, 3, 4, 5, etc.). As explained above, the filter assembly 82 couples to the valve 84. The valve 84 includes an annular portion 94 and a base portion 96. The annular and base portions 94 and 96 may be made of recyclable materials such as plastic. The annular portion 94 enables the filter assembly 82 to couple to the valve 84 and to form a seal with the spray coating supply container 78. In the present embodiment, the base portion 96 includes ribs or panels 98 arranged in the form of an "X", e.g., an x-shaped extrusion. As will be explained in more detail below, the "X" shape enables fluid to pass through the valve 84 and into the spray coating gun 12.

Figure 3:
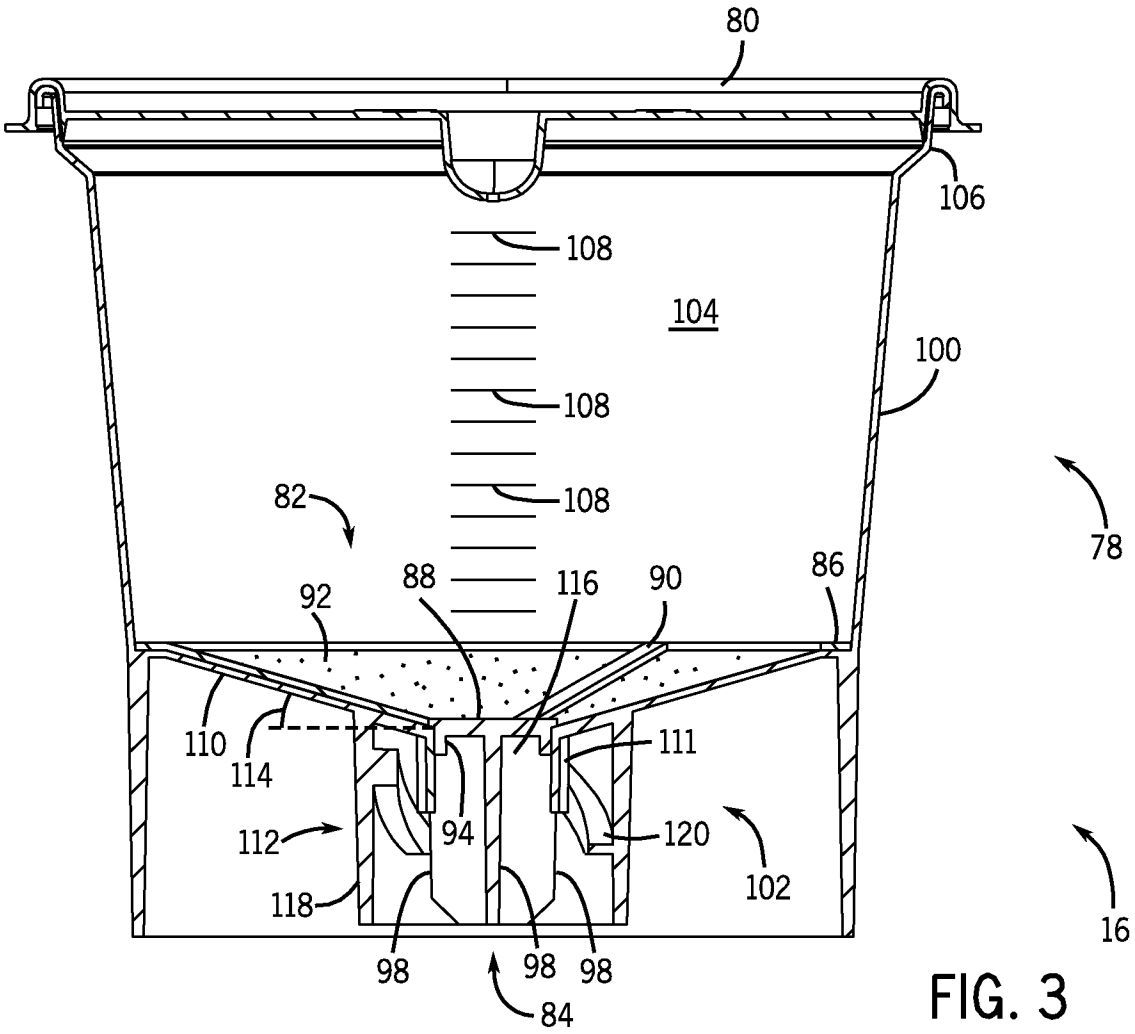
FIG. 3 is a cross-sectional side view of an embodiment of the gravity fed container assembly in a closed position.

FIG. 3 is a cross-sectional side view of an embodiment of the gravity fed container assembly 16 with the valve 84 in a closed position. As explained above, the gravity fed container assembly 16 includes spray coating supply container 78, lid 80, filter assembly 82, and valve 84. The spray coating supply container 78 includes an outer wall 100 and a base 102. Together, the outer wall 100 and base 102 form a chamber 104 that enables the gravity fed container assembly 16 to store a liquid coating material. In addition to forming the chamber 104, the outer wall 100 includes a rim or ledge 106 (e.g., an annular lip) for attachment of the lid 80, and mixing scales 108 (e.g., volumetric marks or indicators). Each mark or scale 108 indicates a volume of liquid in the chamber 104. The mixing scales 108 enable a user to pour and measure an amount of liquid coating material(s) into chamber 104. In addition, the outer wall 100 may be made out of a transparent or translucent material enabling a user to directly measure the liquid coating material(s) in the spray coating supply container 78, saving time and material (i.e., eliminates measurement of liquid coating material in a separate container). The mixing scales 108 may use US standard or metric units, (e.g., fluid ounce, pints, cups, liters, milliliters, or any combination thereof).

The base 102 includes a cone-shaped filter support portion 110 (e.g., base or wall), a valve wall 111, and an adapter connector portion 112 (e.g., adapter receptacle). As illustrated, the cone-shaped filter support portion 110 defines an angle 114 with the valve wall 111. The angle 114 enables the cone-shaped filter portion 110 to guide liquid coating material towards a valve aperture 116 in the center of the cone-shaped filter portion 110. The angle 114 may vary depending on the type of fluid to be sprayed (e.g., approximately 10, 20, 30, 40, or more degrees). For example, the angle 114 may increase for a more viscous liquid coating material to encourage liquid coating material flow towards the valve aperture 116. As illustrated, the filter assembly 82 rests on the cone-shaped filter support portion 110 when the valve 84 is in the closed position. With the filter assembly 82 flush with the cone-shaped filter portion 110, a user is able to mix a liquid coating material(s) within the spray coating supply container 78. Accordingly, the gravity fed container assembly 16 saves the user time and material (e.g., eliminates measurement and mixing of liquid coating material(s) in a separate container).

As explained above, the base 102 includes an annular valve wall 111. The valve wall 111 in combination with the valve 84 control fluid flow out of the spray coating supply container 78. More specifically, the valve wall 111 contacts and creates a sealing engagement with the annular portion 94 when the valve is in the closed position. As will be explained in further detail below, in the open position, the annular portion 94 of the valve 84 disengages from the annular valve wall 111 enabling liquid coating material to flow out of the spray coating supply container 78. The adapter connector portion 112 receives the adapter 86 (seen in FIG. 1). The adapter 86 opens the valve 84 and couples the spray coating supply container 78 to the spray coating gun 12. The adapter connector portion 112 includes an annular wall 118 with a helical or spiral flange 120. The helical flange 120 enables the adapter 86 to couple to the spray coating supply container 78 during operation.

Figure 4:
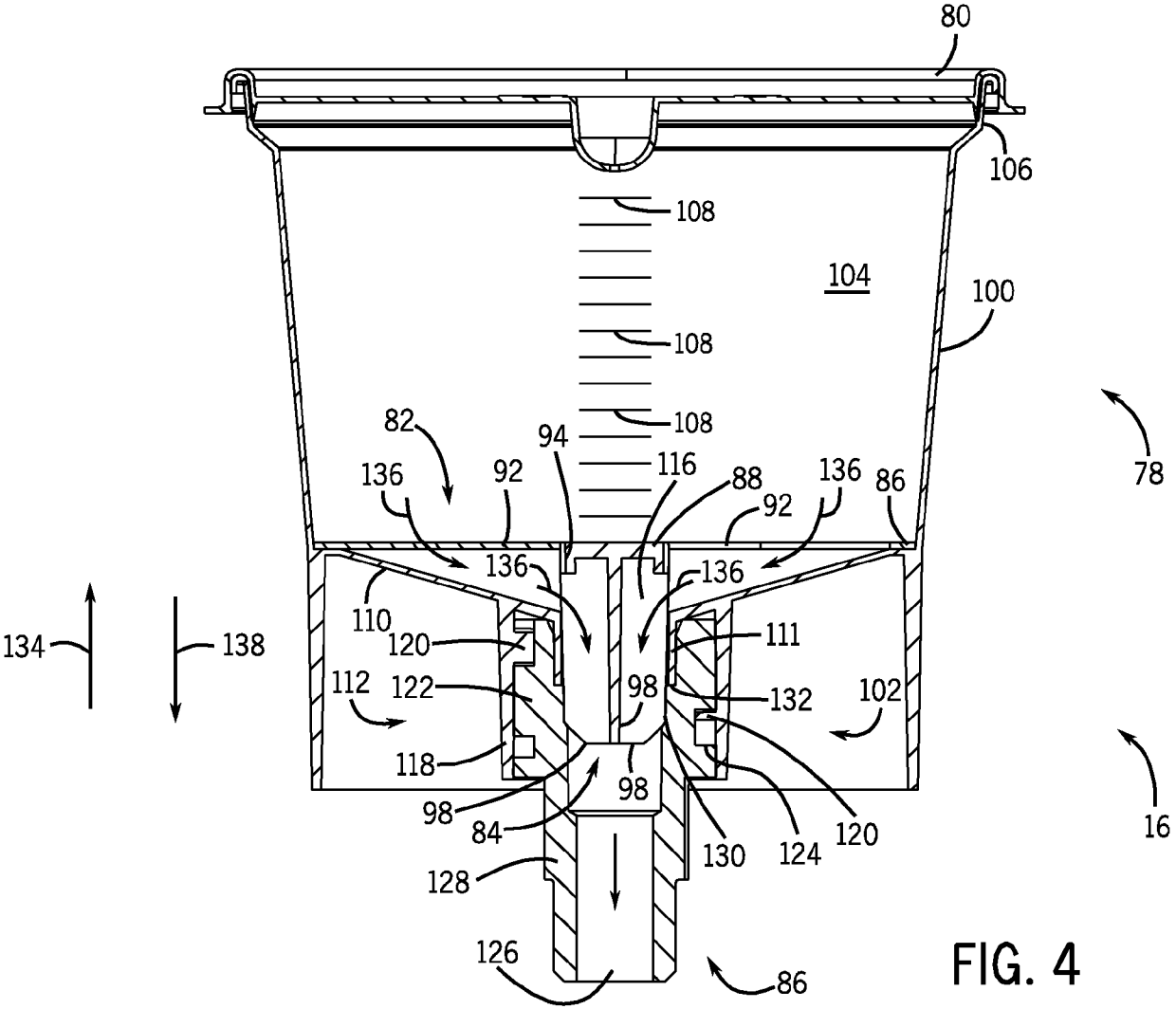
FIG. 4 is a cross-sectional side view of an embodiment of the gravity fed container assembly in an open position.

FIG. 4 is a cross-sectional side view of an embodiment of the gravity fed container assembly 16 in an open position. As illustrated, the adapter 86 connects to the spray coating supply container 78 with a body portion 122. The body portion 122 includes a helical or spiral groove 124 that rotatingly engages the helical or spiral flange 120 of the annular wall 118. As the adapter 86 rotatingly couples to the adapter connector portion 112, the adapter 86 engages the valve 84. More specifically, the adapter 86 engages the valve 84 with a stepped aperture 126. The stepped aperture 126 extends through the body portion 122 and a spray gun connector portion 128, enabling liquid coating material to flow from the chamber 104 and into the spray coating gun 12. The stepped aperture 126 includes a first counterbore 130 (e.g., cylindrical bore) and a second counterbore 132, (e.g., a cylindrical bore) which have different diameters. As the container 78 is connected with the adapter 86 of the gun 12, the first counterbore 130 engages the panels 98 forcing the valve 84 upwards in direction 134. The adapter 86 may continue to move in direction 134 until the second counterbore 132 engages the annular valve wall 111, blocking further movement of the adapter 86. As the valve 84 moves in direction 134, the valve 84 transitions from a closed position to an open position. In addition, because the filter assembly 82 couples to the valve 84, as the valve 84 opens in direction 134 the valve 84 causes the filter assembly 82 to lift away from the conical-shaped portion 110 of the base 102. Thus, movement of the valve 84 simultaneously opens the aperture 116 and lifts the filter assembly 82 into a filtering position (e.g., spaced vertically above the support portion 110). In the filtering position, liquid coating material 136 is able to pass through the mesh 92, the aperture 116, and into the stepped aperture 126 for use by the spray coating gun 12. As illustrated in the present embodiment, the outer ring 86 does not move as the valve 84 moves in direction 134. The outer ring 86 may couple to the conical shaped portion 110 by press fitting, gluing, spot welding, etc. to prevent vertical movement. Accordingly, as the valve 84 moves in direction 134 the valve 84 moves the support arms 90 and the mesh 92, but not the outer ring 86. Thus, movement of the valve 84 in direction 134 forces the support arms 90 to flex away from the conical-shaped portion 110. The support arms 90 resist movement in direction 134 and therefore provide a biasing force (e.g., a spring biasing force) in direction 138 that forces the valve 84 to close when the spray coating supply container 78 separates from the adapter 86. In other words, the arms 90 may function as springs (e.g., resilient spring arms) to bias the filter assembly 82 and valve 84 toward the closed position. When the support arms 90 close the valve 84, the support arms move the mesh 92 into contact with the conical-shaped portion 110. Indeed, because the filter assembly mesh 92 rests against the cone-shaped filter portion 110, the liquid coating material(s) wets the filter assembly 82 (e.g., preventing liquid coating material from drying on the mesh 92 and the valve 84) enabling storage of liquid coating material(s) for later use.

Figure 5:
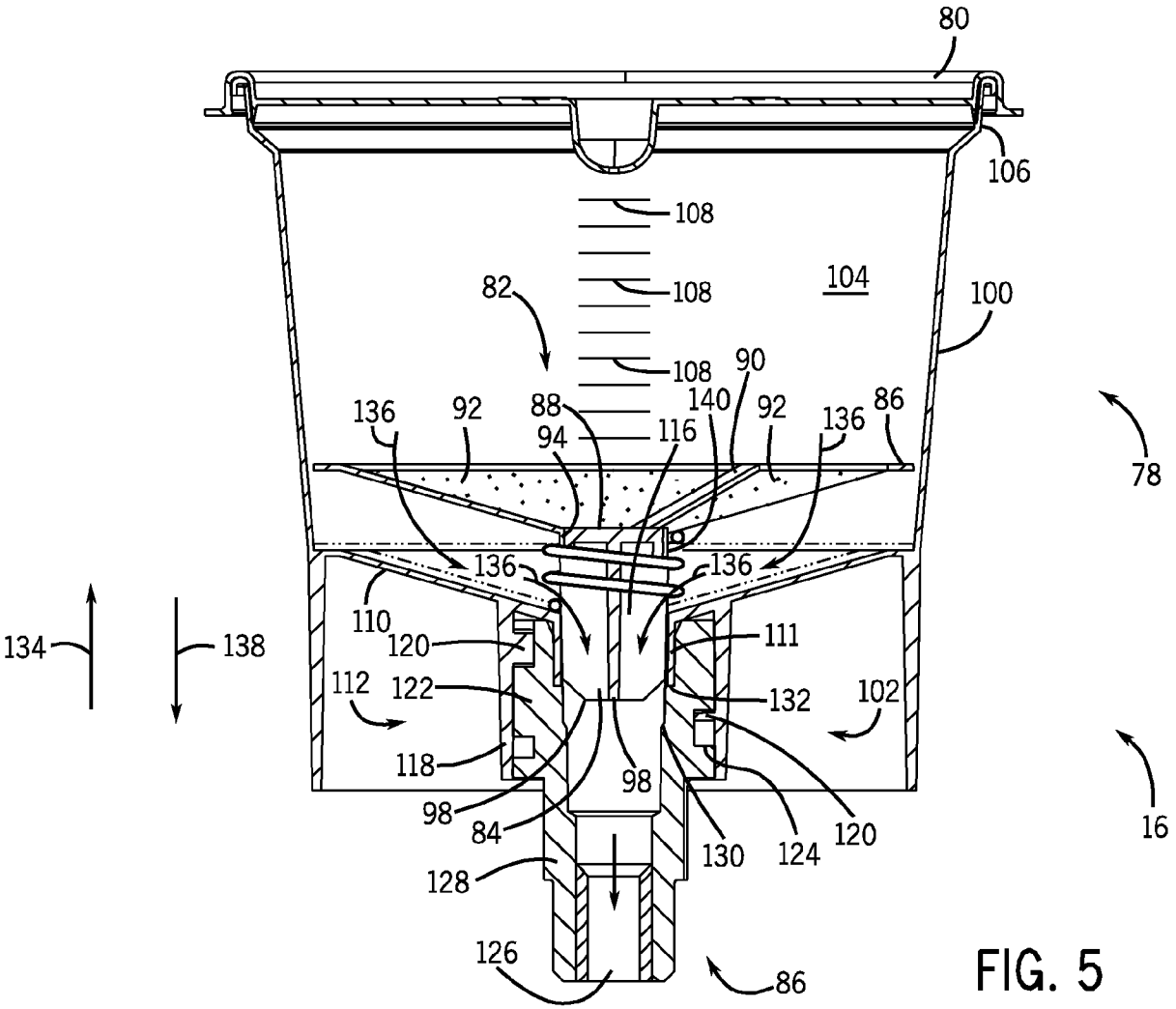
FIG. 5 is a cross-sectional side view of an embodiment of the gravity fed container assembly in an open position.

FIG. 5 is a cross-sectional side view of an embodiment of the gravity fed container assembly 16 in an open position. As explained above, the adapter 86 connects to the spray coating supply container 78 with a body portion 122. The body portion 122 includes a helical groove 124 that rotatingly engages the helical flange 120 of the annular wall 118. As the adapter 86 rotatingly couples to the adapter connector portion 112, the adapter 86 engages the first counterbore 130 of the stepped aperture 126 forcing the valve 84 upwards in direction 134. The adapter 86 may continue to move in direction 134 until the second counterbore 132 engages the annular valve wall 111, blocking further movement of the adapter 86. As the valve 84 moves in direction 134, the valve 84 transitions from a closed position to an open position. Moreover, because the filter assembly 82 couples to the valve 84, as the valve 84 opens in direction 134, the valve 84 causes the filter assembly 82 to lift away from the conical-shaped portion 110 of the base 102. Thus, movement of the valve 84 simultaneously opens the aperture 116 and lifts the filter assembly 82 into a filtering position. In the filtering position, liquid coating material 136 is able to pass through the mesh 92, the aperture 116, and into the stepped aperture 126 for use by the spray coating gun 12. In the present embodiment, the entire filter assembly 82 moves in direction 134. However, a spring 140 coupled to the filter assembly 82 and to the conical shaped portion 110 (i.e., in a groove in the conical shaped portion) biases the valve 84 toward a closed position. More specifically, the spring 140 resist movement of the filter assembly 82 and the valve 84 in direction 134. Thus, when the adapter 86 opens the valve 84 in direction 134, the spring 140 is stretched in tension. Accordingly, after removal of the adapter 86, the spring 140 compresses in direction 138 closing the valve 84 and moving the filter assembly 82 into contact with the conical-shaped portion 110. As explained above, because the filter assembly mesh 92 rests against the cone-shaped filter portion 110 the liquid coating material(s) wets the filter assembly 82 (e.g., preventing liquid coating material from drying on the mesh 92 and the valve 84) enabling storage of liquid coating material(s) for later use. In some embodiments, the gravity fed container assembly 16 may not include the spring 140 or other biasing mechanism to bias the valve 84 in a closed position. Accordingly, once the adapter 86 engages the valve 84 and forces the valve 84 in direction 134 there is no biasing force to return it to a closed position.

Figure 6:
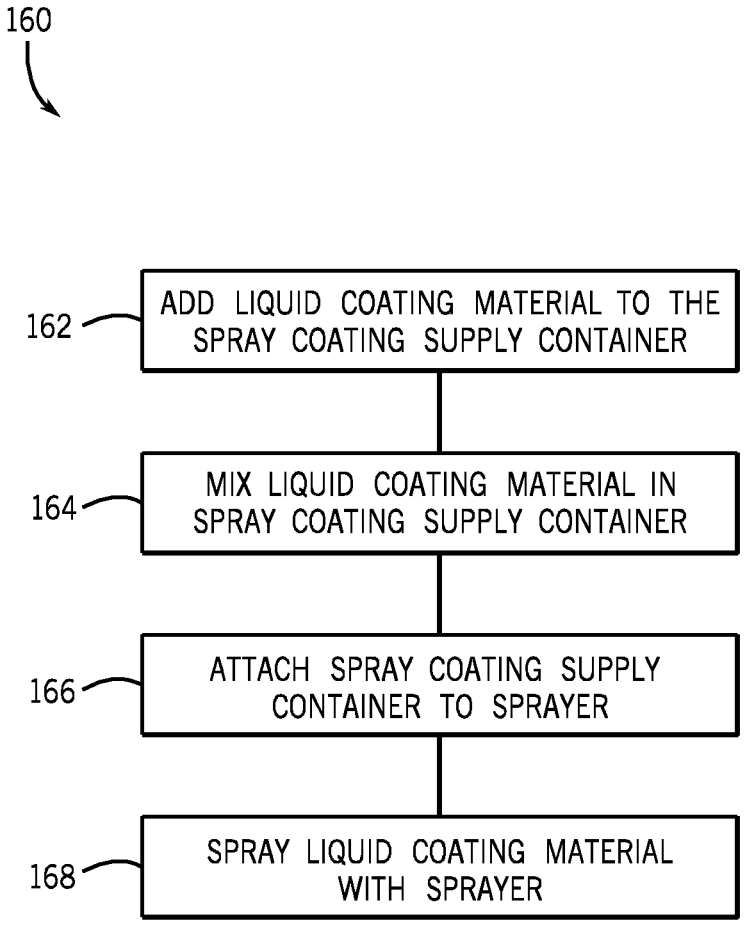
FIG. 6 is a flow chart illustrating an embodiment of a spray coating process utilizing the gravity fed container assembly of FIG. 1.

FIG. 6 is a flow chart illustrating an embodiment of a spray coating process 160 utilizing the gravity fed container assembly of FIG. 1. The process 160 begins by adding liquid coating material to the spray coating supply container 78 (block 162). Specifically, the lid 80 may be removed and a liquid coating material or materials may be poured into chamber 104 of the spray coating supply container 78. As the liquid coating material(s) is added a user may use the mixing scales 108 to measure amounts of liquid coating material(s). After pouring, the liquid coating material(s) are mixed (e.g., stirred in the container 78 or shaken in the container 78 with the lid attached) (block 164). As explained above, before use, the filter assembly 82 rests on the base 102 enabling a user to mix the liquid spraying material in the spray coating supply container 78 (e.g., a user does not need to pour and mix the liquid spraying material in a separate container before adding it to the spray coating supply container 78). In the next step, the spray coating supply container 78 is attached to the sprayer 12 (block 166). A user may then spray liquid coating material with the sprayer 12 (block 168).

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a gravity fed container assembly, comprising;

a container;

a lid configured to cover a chamber in the spray coating supply container, wherein the chamber is configured to hold a spray material;

a filter assembly within the chamber and configured to filter the spray material in the chamber; and a valve coupled to the filter assembly and configured to open when the container couples to a spray device;

wherein the valve is configured to move the filter assembly from a first position to a second position, wherein the first position blocks the filter assembly from filtering the spray material and the second position enables filtering of the spray material, wherein the container comprises a conical bottom wall, the valve comprises a circular portion configured to seal with the conical bottom wall, and the valve comprises a base portion coupled to the circular portion, and the base portion comprising ribs or panels that are configured to allow the spray material to pass through the valve in the second position.

2. The system of claim 1, wherein the filter assembly comprises an outer ring.

3. The system of claim 2, wherein the filter assembly comprises at least one support arm extending from the outer ring to the valve.

4. The system of claim 3, wherein the filter assembly comprises a conical screen extending from the outer ring to the valve.

5. The system of claim 3, wherein the at least one support arm is configured to spring bias the valve.

6. The system of claim 1, wherein the filter assembly rests on the conical bottom wall in the first position, and the filter assembly extends away from the conical bottom wall in the second position.

7. The system of claim 1, wherein the container comprises a plurality of volumetric marks.

8. The system of claim 7, wherein the container comprises translucent or transparent wall having the plurality of volumetric marks.

* * * * *